United States Patent [19]

Leonard et al.

[11] Patent Number: 4,882,573

[45] Date of Patent: Nov. 21, 1989

[54] APPARATUS AND METHOD FOR DETECTING THE PRESENCE OF A BURNER FLAME

[75] Inventors: John K. Leonard, Mississauga; Roland Fabry, Montreal, both of Canada

[73] Assignee: Pullman Canada Ltd., St.Thomas, Canada

[21] Appl. No.: 173,120

[22] Filed: Mar. 25, 1988

[51] Int. Cl.[4] ..... G08B 17/12

[52] U.S. Cl. ..... 340/578; 250/338.4; 250/340; 250/372; 340/522

[58] Field of Search ..... 340/518, 521, 522; 250/338.4, 340, 370.1, 371, 372, 206

[56] References Cited

U.S. PATENT DOCUMENTS

| | | | |
|---|---|---|---|
| 3,476,945 | 11/1969 | Golden et al. | 250/239 |
| 3,665,440 | 5/1972 | McMenamin | 340/578 |
| 3,716,717 | 2/1973 | Scheidweiler et al. | 250/554 |
| 3,940,753 | 2/1976 | Muller | 340/578 |
| 3,967,255 | 6/1976 | Oliver et al. | 340/578 |
| 4,209,776 | 6/1980 | Frederick | 340/566 |
| 4,280,184 | 7/1981 | Weiner et al. | 340/578 |
| 4,370,557 | 1/1983 | Axmark et al. | 250/554 |
| 4,471,221 | 9/1984 | Middleton et al. | 340/578 |
| 4,719,973 | 1/1988 | Allen et al. | 340/578 |
| 4,765,413 | 8/1988 | Spector et al. | 250/372 |
| 4,769,775 | 9/1988 | Kern et al. | 340/578 |

*Primary Examiner*—Glen R. Swann, III

*Attorney, Agent, or Firm*—St. Onge Steward Johnston & Reens

[57] ABSTRACT

A flame detecting device indicates the presence or absence of a flame. The detecting device includes both an IR detector for sensing the IR frequencies of the flame and a UV detector for sensing the UV intensity of the flame. Information is stored defining IR frequency and UV intensity standards. A microcomputer is operatively connected to the IR and UV detectors and compares the two detector outputs to the two respective standards in accordance with a program establishing defined conditions in terms of IR frequency and/or UV intensity that must be met for a flame present or flame absent signal to be rendered on a bar graph display.

33 Claims, 11 Drawing Sheets

APPARATUS AND METHOD FOR DETECTING THE PRESENCE OF A BURNER FLAME

FIELD OF THE INVENTION

The present invention relates to the field of burner flame detection. More specifically, apparatus and a method are provided using two radiation sensors responsive to different portions of the electromagnetic spectrum. A microcomputer analyzes the outputs of the two sensors and provides a "flame present" or "flame absent" signal in accordance with conditions provided by a plurality of different programs chosen by an operator.

BACKGROUND OF THE INVENTION

Flame detection devices, or burner scanners, are well known in the art for monitoring burner flames as part of maintaining safe operating conditions. For example, if fuel such as oil or gas is continuously delivered to a burner even though the flame has failed to ignite or has become extinguished, the results can be an undesirable explosion. The common technique of avoiding such potentially severe consequences is to use an optical scanner, that "watches" the flame and triggers a flame relay for sounding an alarm and cutting off the fuel supply if there comes a time when the scanner fails to "see" a flame.

Flame detection devices using two different sensors are known in the art.

U.S. Pat. No. 3,476,945 to Golden et al. shows a flame detector incorporating two characteristically different elements, each of which responds to the flame characteristics of a specific fuel. Golden et al. describes the use of an ultraviolet radiation detector and also a detector primarily sensitive to visible and near infrared radiation.

Another dual detector flame sensor is shown in U.S. Pat. No. 4,370,557 to Axmark et al., wherein the outputs of a visible light sensor and an infrared sensor are amplified and then summed in an adder. The output from the adder is then passed through a variety of amplifiers and rectifiers to an indicator or alarm.

U.S. Pat. No. 3,665,440 to McMenamin shows a fire detector using ultraviolet and infrared sensors, wherein the respective outputs of the two sensors are fed into a false alarm inhibit circuit. There is no output signal from this inhibit circuit unless the ultraviolet detector is not detecting ultraviolet radiation, or the ultraviolet radiation being detected is at a frequency outside the passing band of a band pass amplifier. The system is designed to inhibit the setting off of false alarms by, for example, stray illumination from a match or cigarette lighter flame.

U.S. Pat. No. 3,940,753 to Müller shows a flame detection device using at least two photoelectric sensors, which are sensitive to different spectral ranges of incident light. The relationship between the AC components of the two sensed output signals is evaluated to determine whether a "flame present" signal should be provided.

Other dual sensor devices include the flame detector and electrical detection circuit of U.S. Pat. No. 3,716,717 to Scheidweiler, et al. and the flame detection system of U.S. Pat. No. 3,967,255 to Oliver et al.

However, these prior art devices are limited in their usefulness for different burner types and arrangements, different fuels, different furnace capacities, and applications wherein susceptibility to power line noise may be particularly acute.

SUMMARY OF THE INVENTION

In accordance with a preferred embodiment of the present invention, a flame detector apparatus is provided employing two sensors primarily responsive to differing portions of the electromagnetic spectrum, preferably an ultraviolet (UV) detector and a detector responsive to both visible light (VL) and infrared (IR). A microcomputer monitors the outputs of these two sensors alternately and decides whether a "flame present" signal is indicated by comparing the sensor outputs to two threshold levels or set points input by an operator through a suitable input means, such as for example a portable keyboard input (PKI). The microcomputer reaches this decision in accordance with a program chosen by the operator from a plurality of available programs, which define a variety of conditions which must be met for a "flame present" signal to issue. The microcomputer outputs the results to a bar graph display and also to a flame relay for de-energizing the burner if necessary.

By operator keyboard programming, the operator can select "IR only", "UV only", "IR or UV", or "IR and UV". If "IR only" is chosen, a flame present signal will issue if and only if the flicker frequency of the flame being monitored exceeds the IR frequency set point chosen by the operator through the PKI. If "UV only" is chosen by the operator, a flame present signal will be rendered if and only if the intensity of the ultraviolet radiation component of the flame exceeds the UV intensity set point selected by the operator. If "IR or UV" is selected, a flame present signal will be rendered if either the IR or the UV conditions are met. If "IR and UV" is selected, both the IR and UV conditions must be met for a flame present signal to issue.

Also in accordance with a further preferred embodiment of the present invention, the frequency output of the IR detector is sampled, and any frequency components substantially at the power line frequency or its harmonics are ignored in determining whether the IR flicker frequency of the flame meets or exceeds the IR flicker frequency threshold or set points. In this manner, noise at the power line frequency is minimized.

Also in accordance with a further preferred embodiment of the present invention, to determine UV intensity, the microcomputer monitors the time t that elapses between the energization of the UV detector, preferably a UV tube at $t_2$, and the firing of the UV tube at $t_2$ as a means of determining the intensity of the UV radiation emanating from the burner flame being monitored.

Also provided is a method of monitoring the burner flame in accordance with a chosen one of several programs selected by the operator.

It is an object of the present invention to provide a burner flame detection device that permits operator choice of programs according to a variety of parameters associated with burner operation, including but not limited to the type, number, and arrangement of burners; the type of fuel; the burner size; BTU output; the rate of fuel flow; and the rate of oxygen consumption.

It is a further object of the present invention to provide a burner flame detection device that may be readily sighted on a flame and adjusted to effectively and safely monitor the particular flame with a minimum of difficulty.

It is a further object of the present invention to provide a burner flame detection device that is relatively insensitive to power line noise.

It is a further object of the present invention to provide a burner flame detection device that maximizes discrimination performance.

It is a further object of the present invention to provide a burner flame detection device having an IR flicker frequency sensor that uses a microcomputer as a counter with discrete frequency selectable breakpoints using the PKI.

It is a further object of the present invention to provide a burner flame detection device using timing control via the microcomputer for achieving control of UV tube sensitivity, thereby substantially reducing required operator adjustments.

Further objects and advantages of the present invention will become apparent from the following brief description of the drawings and the detailed description of the preferred embodiment.

DETAILED DESCRIPTION OF THE PREFERRED EMBODIMENT

Figures 1, 1A:
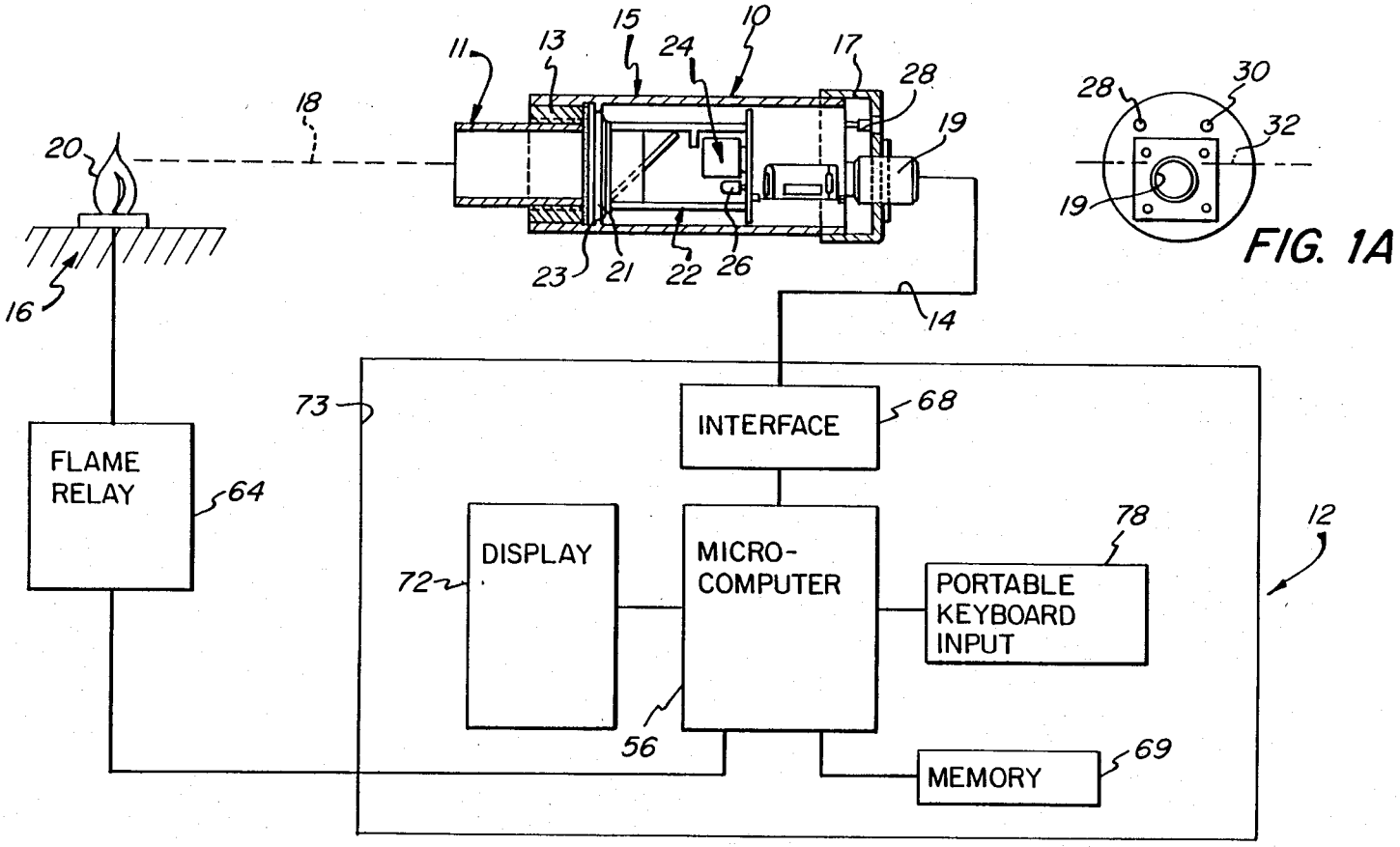
FIG. 1 shows an overall schematic view of the detector scanner head of the present invention in combination with the microcomputer-based remote unit.
FIG. 1A shows an end view of the detector scanner head of FIG. 1.

The burner flame detector of the present invention is shown generally in FIG. 1. A scanner head 10 is operatively connected to a remote unit 12 via a shielded cable 14. Scanner head 10 is for focusing optically on a burner 16, where the presence or absence of flame 20 is to be monitored. Electromagnetic radiation emitted by flame 20, if in fact flame 20 is present, is emitted along line of sight 18 to scanner head 10.

Scanner head 10 in a preferred embodiment comprises a nipple 11 joined with a bushing 13 further joined to housing 15. End piece 17 contains a socket 19. A lens 21, preferably of quartz, permits the entry of radiation from flame 20 into scanner head 10. Gasket 23 is for sealing the interior of the scanner head against dust and other foreign matter. Other suitable constructions can of course be used as well. A self-check shutter assembly 22 is operated by the control electronics described below to periodically open and close and thereby periodically permit the passage of the radiation through to the scanner head detector circuitry.

The preferred embodiment of the scanner head 10 further includes an ultraviolet (UV) tube 24 and an infrared and visible light (IR and VL) phototransistor 26. For convenience only, phototransistor 26 is referred to hereinafter as the IR detector, omitting any direct reference to visible light. Sighting aid LEDs 28 (for UV) and 30 (for IR and VL) assist the operator in focusing the scanner head 10 on flame 20. The operator watches the LEDs as he or she adjusts the scanner head position. The LEDs glow more brightly when focusing is more direct. The sighting aid LEDs 28 and 30 are best seen in an end view 32 of scanner head 10 shown in FIG. 1A.

Remote unit 12 is built around microcomputer 56 and contains the control electronics for selecting the program for operation of the flame detector via portable keyboard input (PKI) 78; for selecting the IR flicker frequency set point via PKI 78; and for selecting the UV intensity set point via PKI 78. Suitable memory 69 is provided for storing information, such as for example information from said PKI 78.

The remote unit 12 issues a "flame present", "flame not present", or "flame marginal" signal to an operator via a suitable display 72, and also is designed to trip a flame relay 64 for sounding an alarm, stopping the flow of fuel to burner 16, or taking other appropriate action, in the event a flame absent signal is received when in fact a flame should be present. Remote unit 12 is typically enclosed in a housing or chassis represented by line 73. Microcomputer 56 is coupled to scanner head 10 by routine interface circuitry 68.

Figure 2:
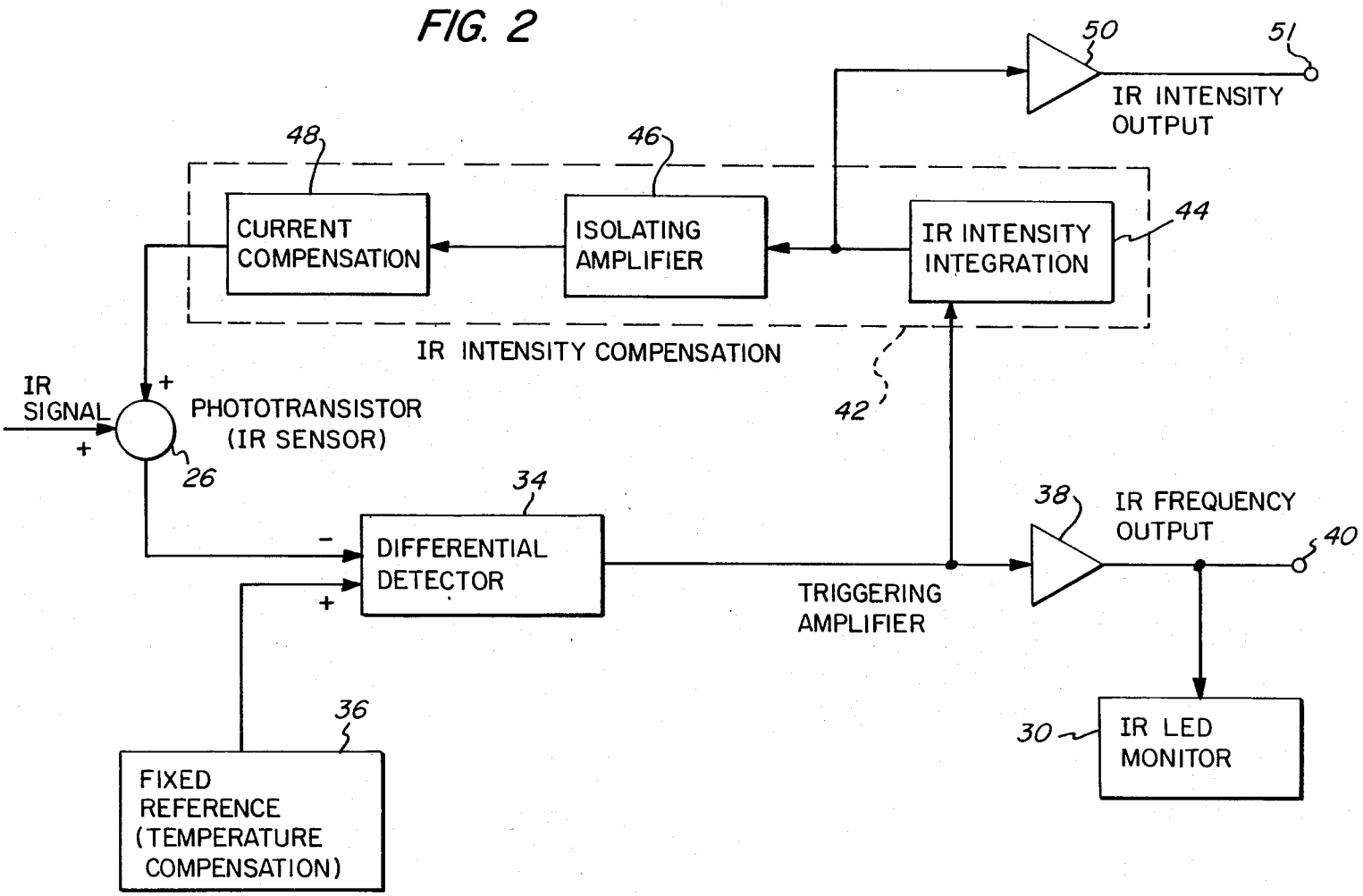
FIG. 2 is a block diagram of the IR detector circuitry of the scanner head of the present invention.
Figure 2A:
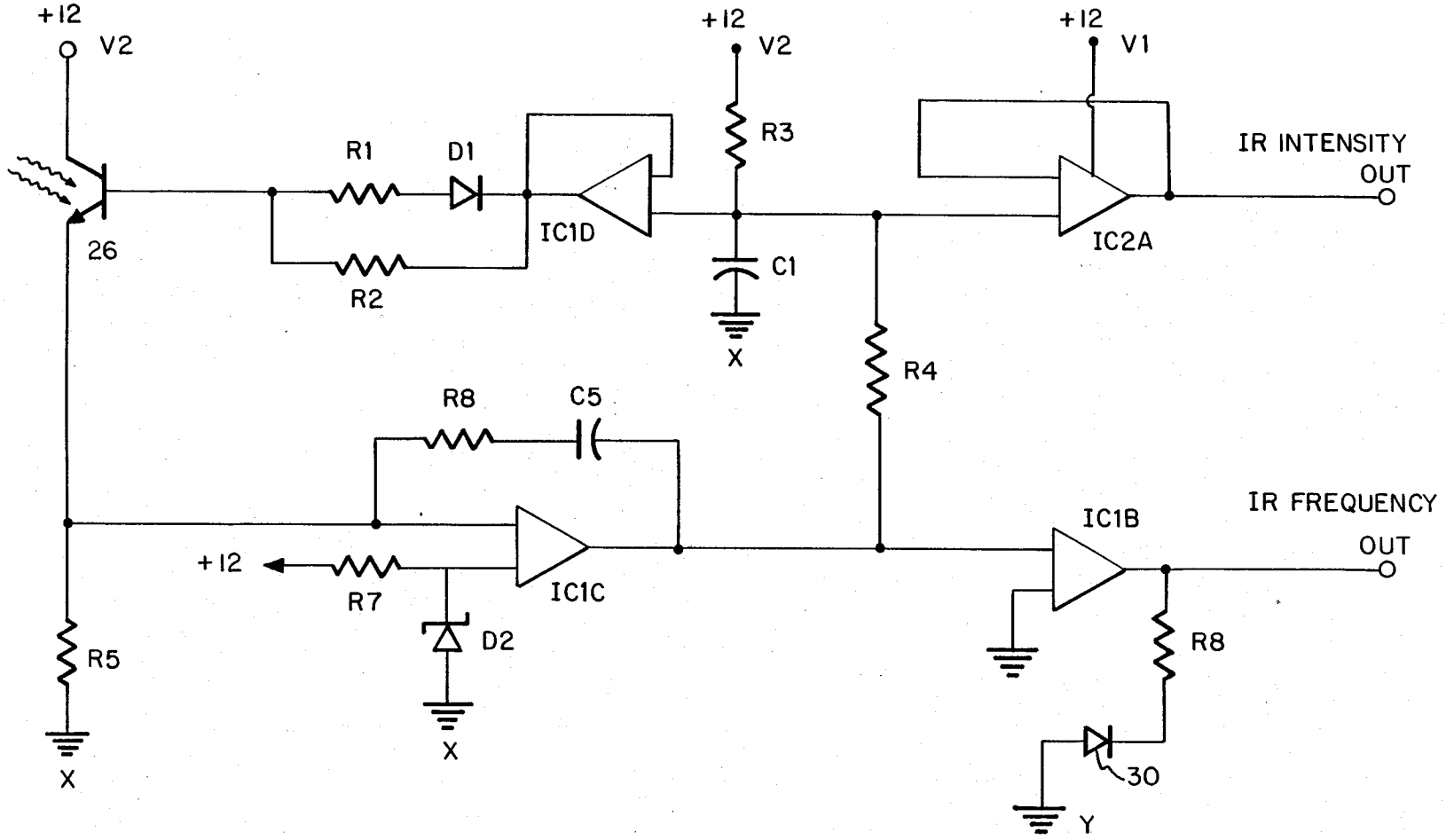
FIG. 2A is a more detailed circuit diagram of the IR detector circuitry shown in block diagram form in FIG. 2.

The electrical schematic in block diagram form for the IR detector circuitry of the scanner head is shown in FIG. 2. The IR sensor is preferably phototransistor 26, although other suitable sensing means could be used. Phototransistor 26 preferably has a spectral response of approximately 400 to 1,000 nm, which covers approximately the visible light to the infrared portion of the spectrum, although other suitable spectrum ranges might be used as a matter of design. Phototransistor 26 senses infrared and visible light radiation (referred to herewith collectively as IR) from flame 20 and becomes conducting if sufficient IR radiation is present. The signal from phototransistor 26 is input into differential detector 34, which compares the signal from phototransistor 26 with a fixed reference signal from 36. Element 36 preferably comprises a temperature compensated zener diode D2 as shown in FIG. 2A. The output from differential detector 34 is the difference signal that drives the unity gain buffer amplifier or triggering amplifier 38 to provide the IR frequency output signal at 40. The sighting aid LED monitor 30 is energized by this IR frequency output signal to assist the operator in sighting the scanner head on flame 20. The output signals at 51 and 40 have an amplitude and frequency that are proportional to the IR radiation level and flicker frequency of the flame 20.

The sensitivity and temperature stability of phototransistor 26 are achieved by negative feedback circuitry controlling the base drive of phototransistor 26, as shown inside dotted lines 42 and designated the IR intensity compensation circuitry. The feedback stability is controlled by the IR intensity integration circuit 44, isolating amplifier 46, and current compensation circuit 48 which close the feedback loop for good temperature voltage stability of the sensing circuitry. The buffer amplifier 50 provides an output for the IR intensity at 51. This feedback control circuit adjusts the gain to reduce the sensitivity of the sensing circuit to a change in intensity of the IR radiation levels emitted by the flame 20. In this manner the IR sensing circuitry is made less sensitive to the output level of the burner; that is, less sensitive to whether the burner is turned up high for higher BTU output or is turned down low for lower BTU output.

FIG. 2A shows a preferred embodiment of the IR detection circuitry in more detail. Capacitor C1 is 1 microfarad nonpolarized, and C5 is 0.01 microfarad. Diodes are Dl (IN914) and D2 (Zener, 6.8v, 1w). Integrated circuits are IC1B, IC1C, and IC1D (TC084) and IC2A (TC084). Resistors are R1 and R5 (10K, ¼w); R2, R3, and R4 (37.4K, ¼w); R7 (1K); and R8 (220 ohm ½w). The combination of R1, R2, D1, IC1D, R3, and C1 provides a feedback control circuit that adjusts the gain and therefore the base drive to phototransistor 26 to make the IR detector circuitry less sensitive to change in intensity levels.

Figure 3:
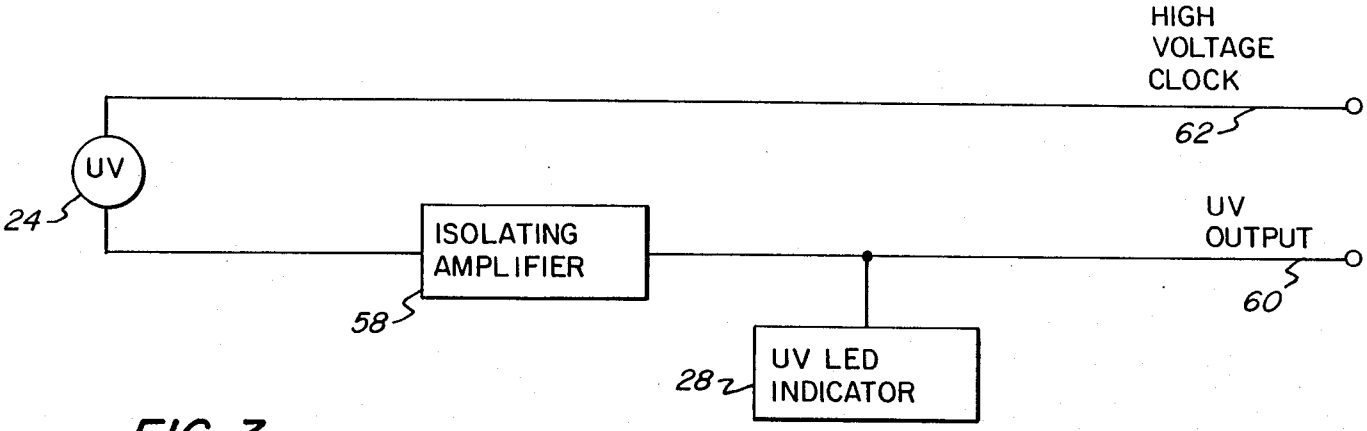
FIG. 3 is a block diagram of the UV detector circuitry of the scanner head of the present invention.

FIG. 3 shows the UV detection circuitry. The UV detector tube 24 has a preferred spectral response of about 190 to 250 nm and is of the avalanche type, such that when photons of sufficient energy in the UV range strike a negatively charged electrode, electrons will be emitted from it. If a sufficiently high voltage is present, these free electrons will be accelerated in the direction of the positive electrode and in their path of travel through the gaseous atmosphere will ionize the gas, thus producing a gas discharge. This event causes the UV tube 24 to become conductive as long as the voltage during the highest period under consideration is above the quenching voltage for the discharge. The tube 24 will stop firing once the voltage drops below that level and fire again (if UV protons are still present) on the next highest period. Positive electron voltage, preferably approximately 450 volts D.C., is provided under control of the microcomputer 56. When the UV tube 24 fires, the unity gain output amplifier or isolating amplifier 58 sends this signal to microcomputer 56 on line 60 and to the sighting aid diode 28. The higher the UV signal level, the brighter the LED 28 will illuminate. The UV output signal representative of the intensity of the UV radiation impinging on UV tube 24 is provided at 60. The high voltage clock input from the microcomputer 56 is provided to the UV circuitry at 62.

Figure 4:
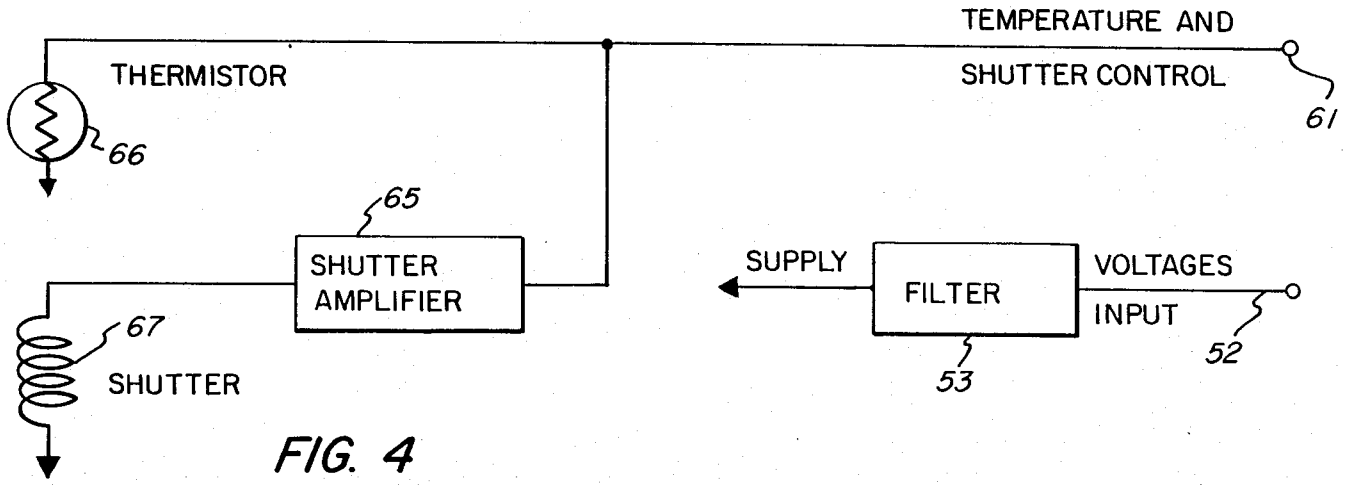
FIG. 4 is a block diagram of the temperature sensor and shutter drive circuitry of the scanner head.

The shutter control circuitry is shown in FIG. 4. A microcomputer controlled mechanical shutter 67 is actuated once every preselected time period, preferably every four seconds, with the shutter 67 being closed for preferably approximately half a second. It is understood that other suitable time periods can be used as a matter of design. During the closed period, the microcomputer 56 checks for the UV and IR signals to drop to a minimum signal in order to check the system for component failure. If any of the above signals do not drop to a minimum, the microcomputer 56 will shut the system down and will de-energize the flame relay 64. This shutter 67 operates through a shutter amplifier 65. Operation is by rotation of a butterfly valve employing a D.C. magnet and a core, which is energized by a positive D.C. voltage for one direction of rotation or a negative D.C. voltage for the other direction of rotation. The failure to energize the core will result in the shutter not moving and a fault being sensed by microcomputer 56.

The scanner head 10 is designed to operate at approximately 100° Centigrade in any position. A resistance temperature detector, such as thermistor 66, is mounted in the scanner head 10, and the signal therefrom is transmitted to microcomputer 56. When the maximum design temperature is reached, microcomputer 56 will output to a diagnostic LED mounted on the chassis of the remote unit 12 and energize a relay for remote enunciation and thereby indicate the temperature condition to the operator. As an additional feature, memory 69 or other appropriate memory means can be used to store the highest temperature reached by the head 10 during an operating period. In this manner, an operator can review the temperature record of the head 10 for the highest temperature reached.

As shown in FIG. 4, the temperature and shutter control signals are received and sent along a single line 61. This is accomplished by multiplexing the signals. This multiplexing feature is desirable because it permits an 8-wire cable 14 to be used, which in turn permits an 8 pin socket to be used at 19. An 8 pin socket is advantageous, in that it maximizes the distance between the pins.

A suitable input voltage for circuit operation is routinely provided on line 52 through filter 53 as shown in FIG. 4.

Figure 5:
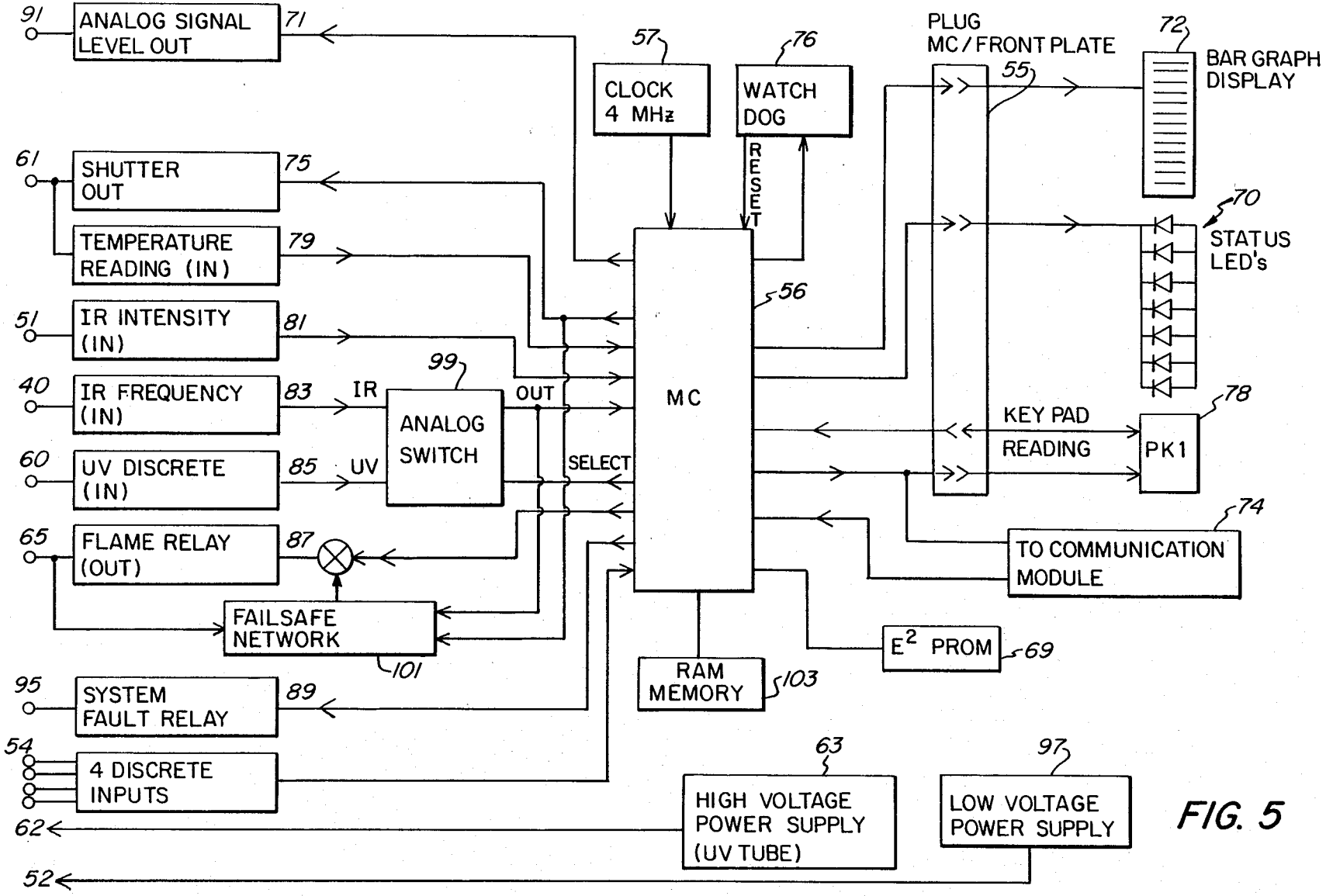
FIG. 5 is a block diagram of the microcomputer-based remote unit.
Figure 6A:
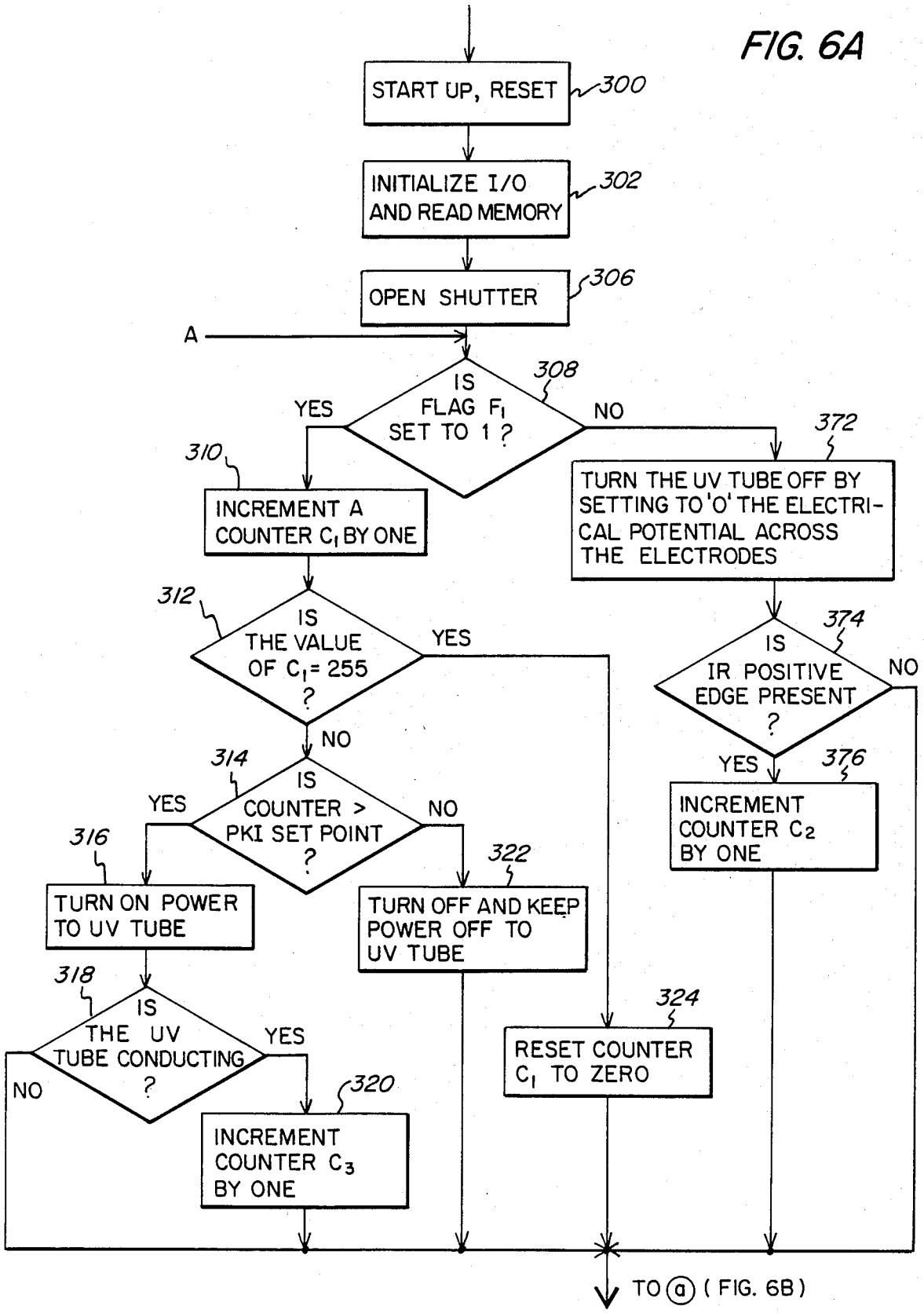
FIGS. 6A–6D disclose a flowchart describing the main operational steps of the method of the present invention using the scanner head and the microcomputer-based remote unit of the present invention.
Figure 6B:
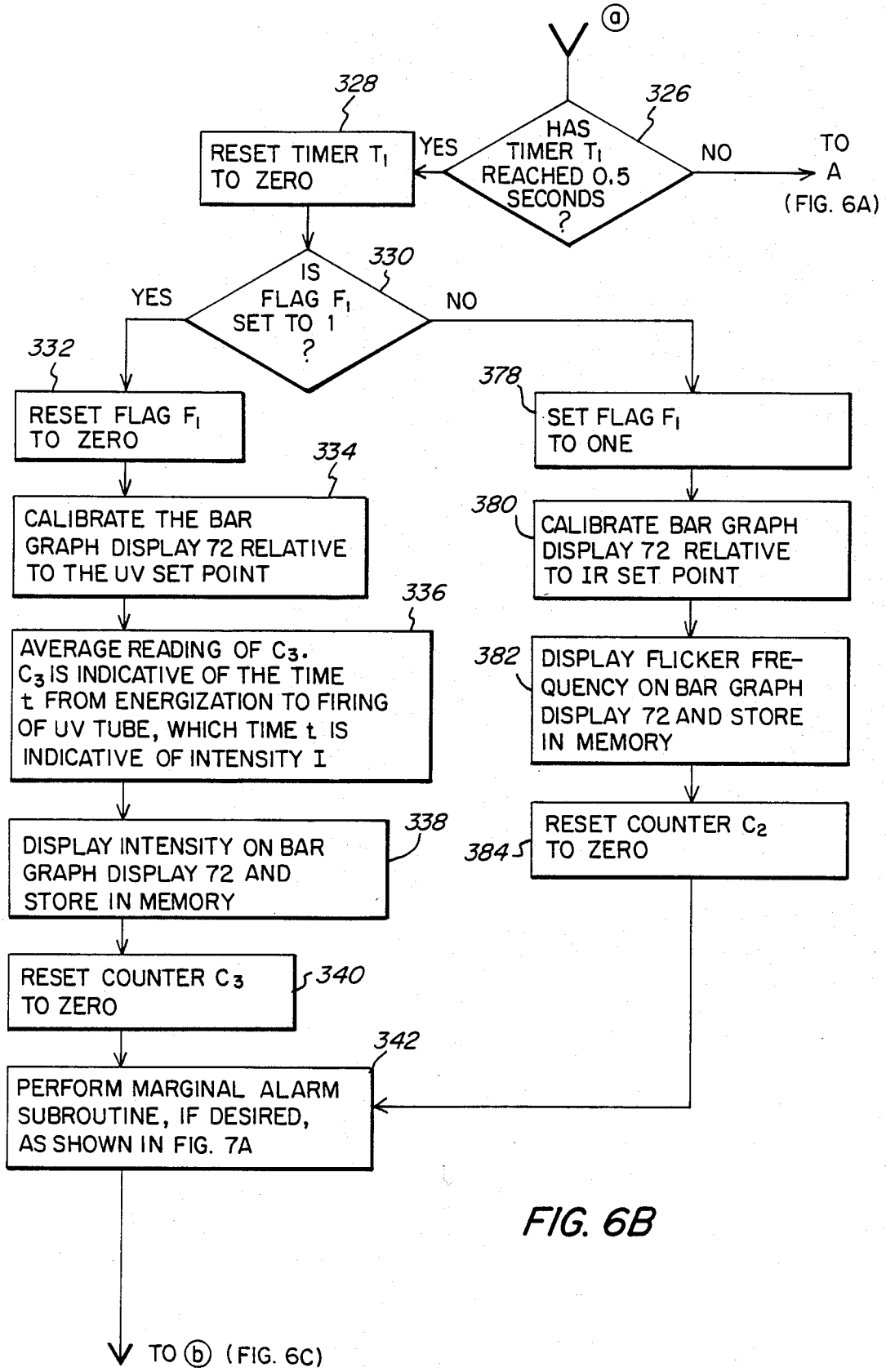
Figure 6C:
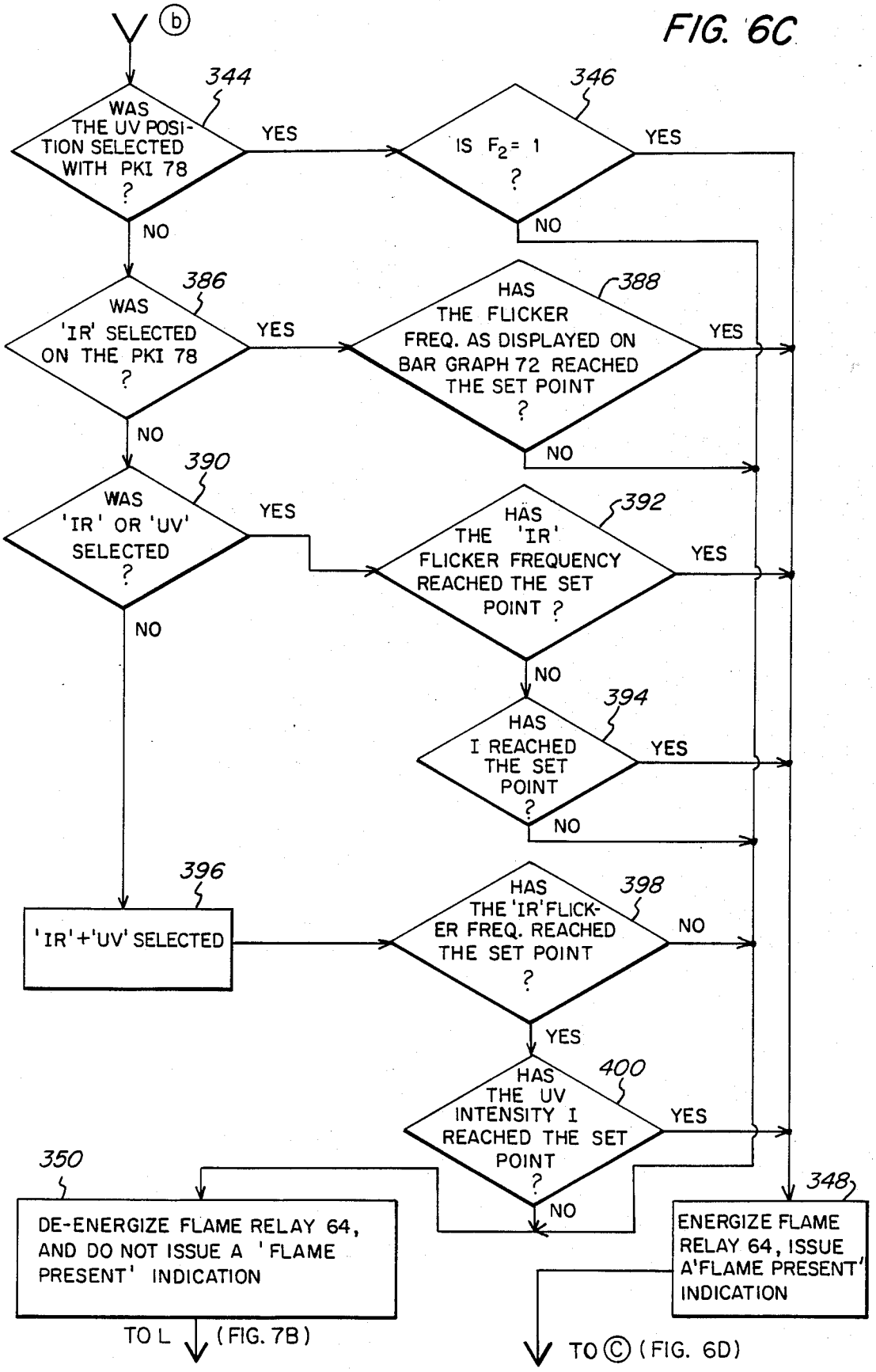
Figure 6D:
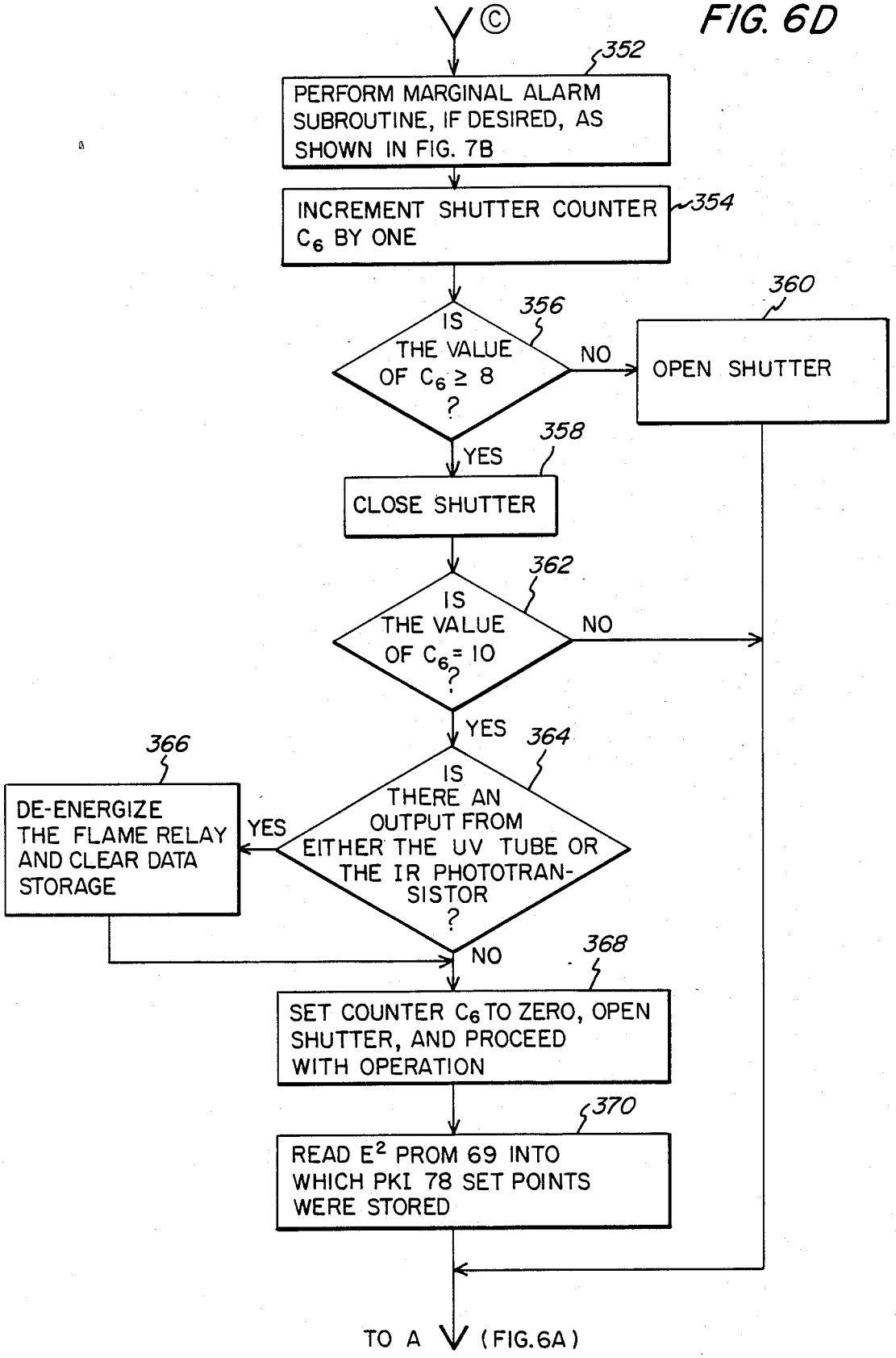

FIG. 5 shows a preferred control electronics block diagram for the flame detector of the present invention, with respect to the preferred embodiment described here. The scanner head 10 is preferably connected to the remote unit 12 by a 100% shielded 8-wire cable 14. Figure numbers 51, 40, 62, 60, 61, and 52 in FIGS. 2, 3, and 4 match like figure numbers in FIG. 5 to indicate electrical connections through cable 14. Additionally, an energizing or de-energizing signal can be sent to flame relay 64 on line 65 depending upon whether the microcomputer 56 senses a "flame present" or "flame absent" condition.

The control electronics in remote unit 12 consist preferably of CMOS interface logic, shown generally at 68; a microcomputer chip (MC) 56 (preferably a Motorola MC68705RL3) with associated clock circuitry 57; conventional electrically erasible PROM ($E^2$ PROM) 69 for program and other data storage; diagnostic LEDs 70; bar graph display 72; output programming and diagnostic connector 74 for connecting the remote unit 12 to a remotely located testing or diagnostic center; a watchdog circuit 76; and PKI 78.

The terminals with matching numbers in FIGS. 2, 3, and 4 mate with the corresponding terminals in FIG. 5 via cable 14. The interface between the remote unit 12 and the scanner head 10 is accomplished with suitable, routine interface circuitry indicated generally at 71, 75, 79, 81, 83, 85, 87, and 89.

Both the IR and the UV signals are continuously sent to the control electronics of the remote unit 12.

Additionally, at 91 there is provided an output for connecting to a remote display such as a flame meter. At 95 there is provided an output for remote monitoring of the general status of the system if desired.

One of the four discrete inputs at 54 can be used to monitor the power line frequency as part of the filtering of power line frequencies from the IR output.

Analog switch 99 permits control of which input, IR or UV, is selected to be monitored by microcomputer 56.

Fail safe network 101 ensures that, no matter what happens to MC 56, the system will fail in a safe mode with the flame relay de-energized.

The high voltage power supply for the UV tube is shown at 63, and the low voltage power supply at 97.

Suitable RAM or working memory 103 is also provided for information storage as needed.

The selection by an operator of software programs designed to process these IR and UV signals is made by PKI 78. PKI 78 will select whether (1) an IR signal will be processed, (2) a UV signal will be processed, (3) whether both IR and UV signals will be processed in an "or" configuration, or (4) whether both IR and UV signals will be processed in an "and" configuration.

The PKI 78 will select the frequency flicker $F_{min}$ that the IR flame signal from the circuitry of FIG. 2 must reach and maintain for a preselected time period, preferably at least approximately one second, in order to be considered as a valid "flame present" signal. In the preferred embodiment, this flicker frequency breakpoint may be selected in one Hertz increments with 5 Hertz minimum, and is simply detected by microcomputer 56 by a counting technique over a predetermined time period. IR flicker frequencies less than the selected frequency will not be considered as "flame present" signals.

The intensity threshold level $I_{min}$ for the UV signal to be considered as a valid "flame present" signal may be adjusted via PKI 78 and settable in increments of preferably approximately 100 microseconds (computer scan time) out of a total period of approximately 28 milliseconds.

The desired conditions or programs for "flame present" may be determined by selection through PKI 78, which selects "IR", "UV", "IR or UV", or "IR and UV". This logic is software determined and will energize the flame present output only if the logical conditions are met. The operator selects a program that best matches the type and number of burners, the type of fuel, the fuel flow rate, and other various burner parameters that may be encountered in a particular installation or with particular operating conditions. The "or"logical condition means that either the IR signal whose flicker frequency is above the selected frequency IR signal, or the UV signal whose level is above the selected level (UV) will result in a "flame present" output. Conversely, the "and" logical condition means that both the IR and the UV signals must exceed the selected levels in order to have a "flame present" output.

A digital bar graph display 72 is connected to the remote unit through a suitable connection or standard plug means 55 and indicates to the operator whether IR or UV relative signal levels have been met. It is preferred to calibrate the bar graph display 72 to display the signal output representing the flame condition in percentages or per unit values, rather than actual values. The halfway, or 50%, point on display 72 is preferably set as the point below which a "flame absent" condition is indicated. In other words, the signal levels from scanner head 10 must be at least sufficient to give a 50% reading on display 72. Otherwise, the flame relay 64 will not be activated. Additionally, a suitable alarm may be provided. If the signal level is at least 50% but less than 70% on display 72, this is regarded as a "flame marginal" condition. When the signal level is over 70% on the display 72, this is regarded as a valid "flame present" condition. Such an arrangement provides a margin of error for the operator and the burner system being monitored. Percentages other than 50% and 70% can of course be used as explained below, depending upon the desired margin for error.

It is understood that the "flame marginal" indication is not necessary to the operation of the burner flame detector of the present invention, or that if desired, the standards for indicating a "flame marginal" condition can be adjusted depending upon the desired margin for error. For example, a preselected constant k or percentage can be used for issuing a "flame marginal" signal unless the signal level exceeds $kI_{min}$. A preselected constant m or percentage, where $m>k$, can be used for not issuing a "flame present" indication unless signal level exceeds $mI_{min}$. The same protocol with constants a and b can also be used for comparing the flame flicker frequency $f_{FF}$ to $F_{min}$ to determine whether "flame absent", "flame marginal", or "flame present" indications should be given.

Additional diagnostic LEDs can be mounted on the housing of the remote unit 12 to indicate as applicable "IR signal-flame present"; "UV signal-flame present"; "marginal signal"; "high scanner temperature"; "power on"; and/or other appropriate messages as desired.

A diagnostic and programming connector 74 is mounted on the front of the chassis of remote unit 12 for providing access to the PKI for reading internal system data such as, for example, "IR flicker frequency", "UV level", internal DC voltages, shutter operation, auto gain control frequency, and the watchdog circuit operation and for operator programming.

In order to protect the system against a random microcomputer failure or spurious noise input levels, a watchdog circuit 76 is incorporated into the system. This is a resettable monostable multivibrator, continuously refreshed by the microcomputer 56, whose output will reset the microcomputer 56 if the refresh signal is absent. This additional safety circuit as designed into the flame scanner will enhance its reliability.

A possible source of noise in the flame detector circuitry is the power line circuitry. The typical range of flicker frequencies that should be detected for a burner flame is approximately 5–500 Hertz. Because power line noise falls within this range, it is desirable to filter, or otherwise remove, such signals from consideration in the IR detection process. The preferred embodiment of the present invention is to do this by including a software routine to in effect "filter" or remove from consideration the power line frequencies or its harmonics.

The system or method of operation of the present flame detector is shown in more detail in the boxes of the flow diagram of FIGS. 6A–6D, which are for the most part self explanatory; however, the following additional comments and description are provided.

Start-up, reset, and initialization of the system is accomplished at boxes 300 to 302.

At box 306, the shutter assembly 22 is opened to permit any radiation from flame 20, if present, to enter the scanner head 10.

At box 308, the system decides whether to perform a UV subroutine first or an IR subroutine. This is accomplished by setting a flag $F_1$. For example, if $F_1$ is set to 1, then the system proceeds with the UV subroutine branch next beginning with box 310. If flag $F_1$ is set to 0, then the system proceeds with the IR subroutine next beginning at box 372. Once the UV subroutine has been performed, then flag $F_1$ is switched to 0 so that the next time the decision point of box 308 is reached, the system will proceed with the IR routine.

Assuming for the sake of simplicity that the flag $F_1$ is set to direct the system to proceed with the UV subroutine, at box 310 a counter $C_1$ is incremented by 1. Various counters known in the art are used as a means of keeping track of time. With respect to UV, the intensity of the impinging UV radiation is determined by the length of time t from the time $t_1$ when electric potential has been placed across the electrodes of UV tube 24 to the time of firing $t_2$. The shorter the time t to fire, the greater the intensity I of the UV radiation, and vice versa. Therefore, by programming $I = f(t)$, the microcomputer can calculate I from t. The various counters $C_1$, et al., are simply a convenient means of keeping track of time.

At box 312, if the value of counter $C_1$ is equal to 255, then counter $C_1$ is reset to zero. If the value of $C_1$ is less than 255, the system proceeds with the UV intensity subroutine at box 314.

Box 314 selects whether the counter $C_1$ has reached the UV sensitivity set point selected by the PKI.

At box 316, the power is turned on to the UV tube 24, by the microcomputer 56, which energizes tube 24 along the high voltage clock line 62.

At boxes 318 through 324, various counters are incremented until the UV tube fires. By knowing the value of the counters, the time that it has taken the UV tube to fire can be determined. Once the UV tube has fired, and the time it has taken the UV tube to fire is stored in the counters, the system proceeds to box 326. Timer $T_1$ provides approximately a 0.5 second delay into the system for purposes of stability. Once timer $T_1$ has timed out at 0.5 second, then the system decides again whether to proceed with the UV subroutine or the IR subroutine as determined by the setting of flag $F_1$ (box 330). Depending upon the setting of $F_1$, the system will proceed with either the UV or the IR subroutine and then will reset the flag $F_1$ (box 332) so that the next time the system encounters a decision point at box 308 it will proceed with the other routine.

Assuming that flag $F_1$ was set for the system to proceed with the UV subroutine, the bar graph display 72 is calibrated at box 334 relative to the UV set point read from PKI 78. The bar graph display 72 is preferably calibrated in percentages or per unit values, with 0 being at the bottom of the display and 100 being at the top of the display. The set point or threshold level for the UV signal set by PKI 78 is preferably set at the 50% or halfway point on the bar graph display.

At box 336, a reading is derived from the value of counter $C_3$ that is indicative of the time t that it took the UV tube to fire.

At box 338, the intensity of the UV signal is displayed on the bar graph display 72 and is also stored in a suitable memory. The UV subroutine is ended by resetting the counter $C_3$ to 0.

At box 342, a marginal alarm subroutine can be provided if desired. This subroutine is explained below with respect to FIGS. 7A and 7B, box 342 being further elaborated on at FIG. 7A.

The system then decides whether the "IR", "UV", "IR or UV", or the "IR and UV" program is to be run and whether the logical conditions are met (Boxes 344, 346, 386, 388, 390, 392, 394, 396, 398, and 400). If the logical conditions determined by the program are met, then the flame relay 64 will be energized (box 348) and a flame present indication will be output. If the logical conditions are not met, then flame relay 64 will be de-energized, the flame will be extinguished, and the system will not issue a flame present indication (box 350).

Box 352 represents a further aspect of the marginal alarm routine. This is explained below with respect to FIG. 7B.

Boxes 354 through 370 represent the shutter operation and are self explanatory.

When the system reaches box 370, it then loops back around to point A to repeat the system routine. Assuming that the UV subroutine was performed previously, this time the flag at box 308 will have been reset to cause the system to proceed with the IR subroutine. At 372, the UV tube is turned off by setting the electrical potential to 0 across the UV tube electrodes. Then, by employing essentially the same counting technique as used for the UV tube, the microcomputer determines the flicker frequency of the flame 20 (boxes 374, 376, 326, 328, 330, 378, 380, 382, and 384). As shown at boxes 344, 386, 390, 396, as already described above, the system decides whether the logical conditions are met and whether to issue a flame present signal or not.

The system continues operating by looping around in such a manner for so long as the system remains in the power up condition.

Figure 7A:
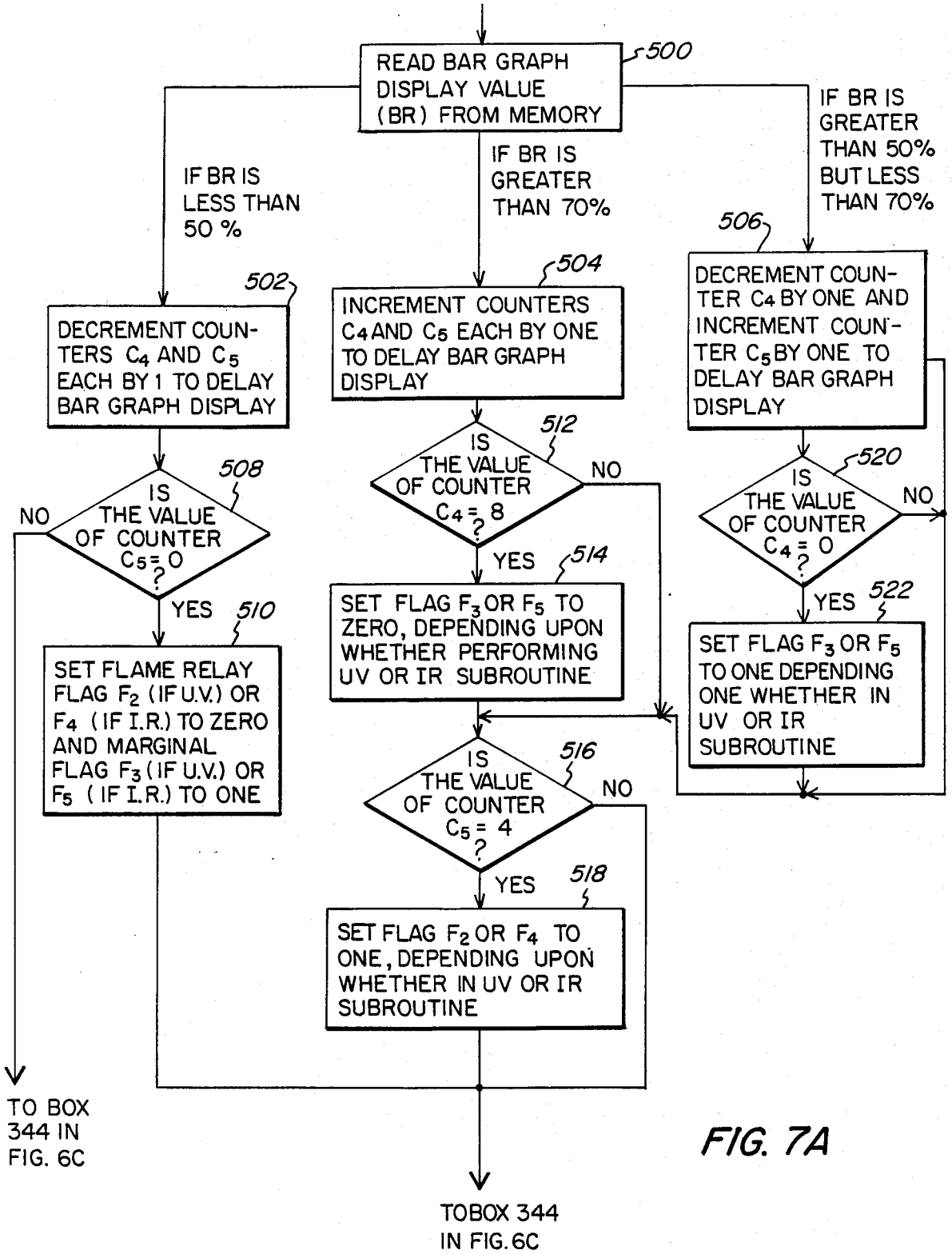
FIGS. 7A–7B disclose a flowchart describing a "flame marginal" subroutine.
Figure 7B:
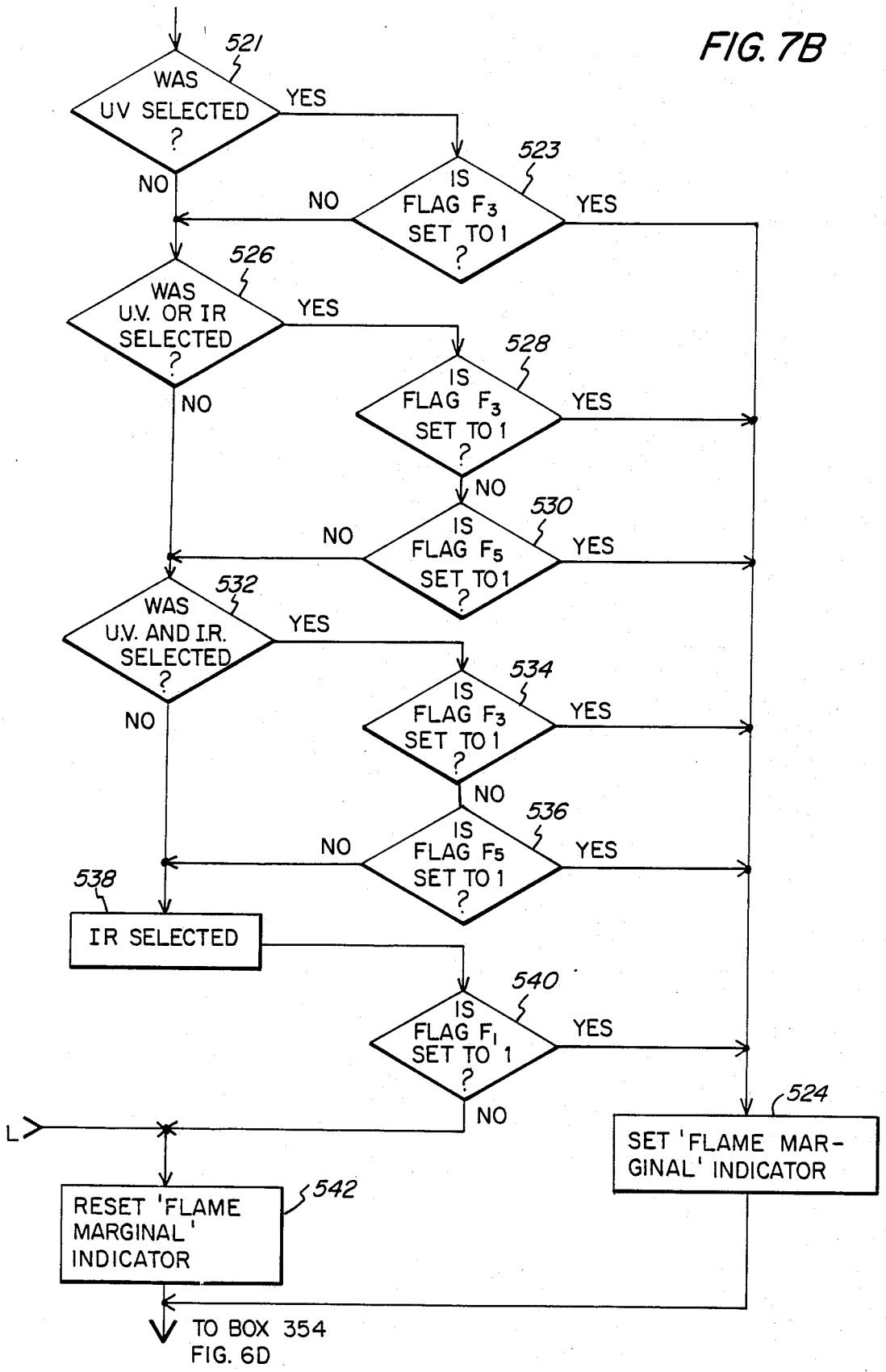

The "flame marginal" subroutine of boxes 342 and 352 can be included or not as desired and are shown in the flow diagrams of FIGS. 7A and 7B, respectively.

At box 500 in FIG. 7A, it is determined whether the bar graph display value (BR), which has been appropriately stored in a suitable memory, is less than 50% ("flame absent" ), greater than 50% but less than 70% ("flame marginal" ), or greater than 70% ("flame present" ).

If "flame absent", then the subroutine defined by boxes 502, 508, and 510 is followed. This introduces a time delay to the bar graph display to prevent an unstable reading. If in the UV subroutine, flags $F_2$ (flame relay flag for UV) and $F_3$ (marginal flag for UV) are set as defined for reading by the system at a subsequent point in the program. If in the IR subroutine, flags $F_4$ (flame relay flag for IR) and $F_5$ (marginal flag for IR) are set as defined.

If "flame marginal", then the subroutine defined by boxes 506, 520, 522, 516, and 518 is followed. This introduces a time delay to the bar graph display to prevent an unstable reading. Either flags $F_3$ and $F_2$ (UV) or $F_5$ and $F_4$ (IR) are set as defined.

If "flame present", then the subroutine defined by boxes 504, 512, 514, 516, and 518 is followed. This introduces a time delay to the bar graph display to prevent an unstable reading. Either flags $F_3$ and $F_2$ (UV) or $F_5$ and $F_4$ (IR) are set as defined.

The second part of the "flame marginal" subroutine is shown in FIG. 7B, where the flags $F_2$, $F_3$, $F_4$, and $F_5$ are read by the system at boxes 523, 528, 530, 534, 536, and 540 in accordance with how the PKI 78 was selected by the operator (boxes 521, 526, 532, and 538). The marginal alarm indicator LED or other indicator may set (box 524) or reset (box 542). The subroutine is then exited.

It should be understood that various changes and modifications to the preferred embodiments described above will be apparent to those skilled in the art. Such changes and modifications can be made without departing from the spirit and scope of the present invention, and it is therefore intended that such changes and modifications be covered by the following claims.

We claim:

1. A flame detecting device for rendering an indication of the presence or absence of a flame, said device comprising:

(a) means for sensing a first radiation spectrum from said flame, said first spectrum being characterized by a first wavelength range, said first radiation sensing means for producing a first signal that varies according with at least one characteristic of said first spectrum, said characteristic including at least the flicker frequency of said flame;

(b) means for sensing a second radiation spectrum from said flame, said second spectrum being characterized by a second wavelength range, said second radiation sensing means for producing a second signal that varies according with at least one characteristic of said second spectrum, said later characteristic including at least the magnitude of at least one frequency component of said second spectrum;

(c) means for storing information defining standards for said first and second signals in terms of said first and second spectrum characteristics respectively;

(d) computer means for receiving said first and second signals and comparing said signals to said first and second standards respectively in accordance with at least one program for so comparing with first and second signals and generating an output signal representative of the presence or absence of said flame in accordance with said program; and (e) output means responsive to said output signal for registering an indication of the presence of absence of said flame.

2. The device of claim 1, further comprising input means for receiving information from an operator defining said standards, program storage means for containing a plurality of programs, and means for permitting selection by said operator of at least one of said programs.

3. The device of claim 2, each said program being individually selectable by said selection means, said plurality of programs comprising:

(a) a first program for directing the issuance of a flame present indication if and only if said first signal satisfies said first standard;

(b) a second program for directing the issuance of a flame present indication if and only if said second signal satisfies said second standard;

(c) a third program for directing the issuance of a flame present indication if and only if either (i) said first signal satisfies said first standard, or (ii) said second signal satisfies said second standard; and (d) a fourth program for directing the issuance of a flame present indication if and only if both (i) said first signal satisfies said first standard, and (ii) said second signal satisfies said second standard.

4. The device of claim 3, wherein said first radiation sensing means is adapted for responding to flame radiation in substantially the infrared range, said second radiation sensing means is adapted for responding to flame radiation in substantially the ultraviolet range, said first signal varies in accordance with at least one flicker frequency of said flame, said second signal varies in accordance with the intensity of said ultraviolet radiation; said first program directs the issuance of a flame present indication if and only if said flame flicker frequency is equal to or greater than a flicker frequency minimum standard selected by said operator through said input means; said second program directs the issuance of said flame present indication if and only if said intensity of said ultraviolet radiation is equal to or greater than said minimum intensity standard selected by said operator through said input means; said third program directs the issuance of said flame present indication if and only if either said flicker frequency exceeds said flicker frequency minimum standard or said ultraviolet intensity exceeds said minimum intensity standard; and said fourth program directs the issuance of said flame present indication if and only if both said flicker frequency exceeds said flicker frequency minimum standard and said ultraviolet intensity exceeds said minimum intensity standard.

5. The device of claim 4, wherein said selection means permits the operator to select from a range of flicker frequency set points for defining said minimum flicker frequency standard.

6. The device of claim 1, wherein said storage means is adapted for storing information defining said first and second standards in terms of a minimum flicker frequency and a minimum magnitude, respectively.

7. The device of claim 1, wherein said first radiation sensing means comprises an infrared radiation detection circuit means, and said first signal varies in accordance with at least one flicker frequency of said flame.

8. The device of claim 1, wherein said first radiation sensing means comprises at least one phototransistor means, and said computer means includes sampling means for sampling the output of said phototransistor means and counting means responsive to said sampling means for deriving an indication of the flicker frequency of said flame.

9. The device of claim 1, wherein said first radiation sensing means comprises a phototransistor responsive to infrared and visible light.

10. The device of claim 9 wherein said second radiation sensing means comprises an ultraviolet tube responsive to ultraviolet light.

11. A method of detecting the presence or absence of a flame, the method comprising the steps of:

(a) continuously monitoring over a predetermined time period the spectrum of frequencies emitted by said flame substantially within the infrared range;

(b) substantially eliminating from the spectrum those frequency components having a frequency of at least one of the power line frequency harmonics;

(c) thereafter comparing said frequency spectrum to at least one preselected flicker frequency $F_{min}$; and (d) indicating a flame present condition if and only if said preselected flicker frequency $F_{min}$ is present in said spectrum.

12. The method of claim 11, further comprising the steps of issuing a flame marginal indication when $f_{FF} > aF_{min}$, and issuing a flame present indication when $f_{FF} > bF_{min}$, where $b > a$, and $f_{FF}$ is the flicker frequency of the flame being monitored.

13. A method of detecting the presence or absence of a flame, the method comprising the steps of:

(a) applying an electric potential across the electrodes of an ultraviolet tube means, said tube means being disposed to receive electromagnetic radiation from said flame and being responsive to radiation substantially in the ultraviolet range;

(b) counting the time t from the time $t_1$ of application of said potential until the time $t_2$ when said ultraviolet tube means becomes substantially conductive between said electrodes;

(c) ceasing the application of said electric potential for a predetermined time period;

(d) deriving from time t an indication of the intensity I of said radiation emitted by said flame;

(e) repeating said steps (a)–(d) for a predetermined time period;

(f) repeatedly comparing I with a preselected minimum intensity $I_{min}$; and (g) issuing a flame present indication when $I > I_{min}$, and issuing a flame absent indication when $I < I_{min}$.

14. The method of claim 13, further comprising the steps of issuing a flame marginal indication when $I > kI_{min}$ and issuing a flame present indication when $I > mI_{min}$, where $m > k$.

15. A method for monitoring at least one burner to detect the presence of absence of a flame associated therewith, said method comprising the steps of:

(a) continuously detecting the spectrum of frequencies emitted by said flame that are substantially within the infrared portion of the electromagnetic spectrum for a preselected length of time;

(b) alternately with step (a), continuously monitoring the intensity of radiation emitted by said flame that is substantially within the ultraviolet portion of the electromagnetic spectrum for a preselected length of time;

(c) issuing a flame present indication if and only if one of the following conditions is met:

(i) a preselected minimum IR flicker frequency is detected;

(ii) the intensity of said ultraviolet portion is equal to or exceeds a preselected minimum intensity;

(iii) either a preselected minimum IR flicker frequency is detected, or the intensity of said ultraviolet portion is equal to or exceeds a preselected minimum intensity; or (iv) both a preselected minimum IR flicker frequency is detected and the intensity of said ultraviolet portion is equal to or exceeds a preselected minimum intensity.

16. A device for monitoring at least one burner to render an indication of the presence or absence of a flame associated therewith, said device comprising:

(a) first means for continuously monitoring over a predetermined time period the spectrum of frequencies emitted by said flame that are substantially within the infrared portion of the electromagnetic spectrum;

(b) second means for continuously monitoring over said predetermined time period the intensity of radiation emitted by said flame that is substantially within the ultraviolet portion of the electromagnetic spectrum;

(c) housing means for containing said first and second means and directing said first and second means toward said burner;

(d) computer means for determining whether at least a selected one of the following sets of conditions is met:

(i) a preselected minimum IR flicker frequency is present in said spectrum;

(ii) the intensity of said ultraviolet portion is equal to or exceeds a preselected minimum intensity;

(iii) either a preselected IR minimum flicker frequency is present in said spectrum, or the intensity of said ultraviolet portion is equal to or exceeds a preselected minimum intensity; or (iv) both a preselected minimum IR flicker frequency is present in said spectrum and the intensity of said ultraviolet portion is equal to or exceeds a preselected minimum intensity; and (e) means for giving an indication of whether the selected one of said set of conditions is satisfied, thereby indicating a flame present condition.

17. The device of claim 16, wherein said determining means comprises microcomputer means programmed to determine whether a selected at least one of said conditions is met.

18. The device of claim 17 further comprising at least one memory means for storing a plurality of programs, said programs including at least one of conditions (i)--(iv), said device further including means for selecting which one of said programs shall control said microcomputer means.

19. The device of claim 18, wherein said indication means includes bar graph means.

20. The device of claim 19, wherein said frequency monitoring means comprises first circuit means including at least one phototransistor means responsive to the infrared portion of the spectrum, and said intensity monitoring means comprises second circuit means including at least one ultraviolet tube means responsive to the ultraviolet portion of the spectrum.

21. A flame detecting device for rendering an indication of the presence of absence of a flame, said device comprising:

(a) infrared radiation detection circuit means for sensing a first radiation spectrum from said flame, said first spectrum being characterized by a first wavelength range, said first radiation sensing means for producing a first signal that varies in accordance with at least one flicker frequency of said flame, said sensing means further having means for desensitizing said first signal to variations in the intensity of said infrared radiation;

(b) means for sensing a second radiation spectrum from said flame, said second spectrum being characterized by a second wavelength range, said second radiation sensing means for producing a second signal that varies according with at least one characteristic of said second spectrum;

(c) means for storing information defining standards for said first and second signals in terms of said first and second characteristics respectively;

(d) computer means for receiving said first and second signals and comparing said signal to said first and second standards respectively in accordance with at least one program for so comparing said first and second signals and generating an output signal representative of the presence of absence of said flame in accordance with said program; and (e) output means responsive to said output signal for registering an indication of the presence of absence of said flame;

22. The device of claim 21, wherein said desensitizing means includes a feedback circuit means inserted in series with the base of at least one phototransistor, said phototransistor for responding to radiation in substantially the infrared range emanating from said flame.

23. The device of claim 22, wherein said feedback circuit means includes at least one diode means, the base drive of said phototransistor being decreased in response to increased intensity of infrared radiation and increased in response to decreased intensity of infrared radiation.

24. A flame detecting device for rendering an indication of the presence or absence of a flame, said device comprising:

(a) means for sensing a first radiation spectrum from said flame, said first spectrum being characterized by a first wavelength range, said first radiation sensing means for producing a first signal that varies according with at least one characteristic of said first spectrum;

(b) means for sensing a second radiation spectrum from said flame, said second spectrum being characterized by a second wavelength range, said second radiation sensing means for producing a second signal that varies according with at least one characteristic of said second spectrum, said second radiation sensing means including at least one ultraviolet tube means;

(c) means for storing information defining standards for said first and second signals in terms of said first and second characteristics respectively;

(d) computer means for receiving said first and second signals and comparing said signals to said first and second standards respectively in accordance with at least one program for so comparing said first and second signals and generating an output signal representative of the presence or absence of said flame in accordance with said program, said computer means including means for measuring the time interval t between the energizing of said tube means and the firing of said tube means, said computer means being responsive to said time interval t to provide an indication of the intensity of said ultraviolet radiation emanating from said burner flame.

(e) output means responsive to said output signal for registering an indication of the presence or absence of said flame.

25. The device of claim 24, wherein said computer means controls the application of an energizing electrical potential to said ultraviolet tube means, and said computer means further comprises counting means for counting how much time elapses between the time $t_1$ of application of said potential and the time $t_2$ when said tube becomes conductive, the intensity I of said UV radiation being substantially a function $I=f(t)$, and said computer means includes a program for determining I as a function of t, wherein $t=t_2-t_1$.

26. A flame detecting device for rendering an indication of the presence or absence of a flame, said device comprising:

(a) means for sensing a first radiation spectrum from said flame, said first spectrum being characterized by a first wavelength range, said first radiation sensing means for producing a first signal that varies according with at least one characteristic of said first spectrum, said first radiation sensing means including an infrared radiation detection circuit means, and said first signal varies in accordance with at least one flicker frequency of said flame, and further including means for substantially removing from the output of said infrared detection circuit means the frequency component of substantially at least one power lien frequency harmonic;

(b) means for sensing a second radiation spectrum from said flame, said second spectrum being characterized by a second wavelength range, said second radiation sensing means for producing a second signal that varies according with at least one characteristic of said second spectrum;

(c) means for storing information defining standards for said first and second signals in terms of said first and second characteristics respectively;

(d) computer means for receiving said first and second signals and comparing said signals to said first and second standards respectively in accordance with at least one program for so comparing said first and second signals and generating an output signal representative of the presence or absence of said flame in accordance with said program; and (e) output means responsive to said output signal for registering an indication of the presence or absence of said flame.

27. The device of claim 26, wherein said removing means comprises at least one program for said computer means, said program for substantially eliminating at least one of said power line frequency harmonics from said first signal before said first signal is compared to a minimum flicker frequency standard selected by said operator through an input means operatively connected to said computer means.

28. A method for monitoring at least one burner to detect the presence or absence of a flame associated therewith, said method comprising the steps of:

(a) continuously detecting the spectrum of frequencies emitted by said flame that are substantially within the infrared portion of the electromagnetic spectrum for a preselected length of time;

(b) alternately with step (a), continuously monitoring the intensity of radiation emitted by said flame that is substantially within the ultraviolet portion of the electromagnetic spectrum for a preselected length of time by the steps of (i) applying an electronic potential across the electrodes of an ultraviolet tube means, said tube means being disposed to receive said ultraviolet radiation;

(ii) counting the time t from the time $t_1$ of application of said potential until the time $t_2$ when said ultraviolet tube means becomes conductive between said electrodes; and (iii) deriving from time t an indication of the intensity of I of said ultraviolet radiation emitted by said flame; and (c) issuing a flame present indication if and only if one of the following conditions is met:

(i) a preselected minimum IR flicker frequency is detected;

(ii) the intensity of said ultraviolet portion is equal to or exceeds a preselected minimum intensity;

(iii) either a preselected minimum IR flicker frequency is detected, or the intensity of said ultraviolet portion is equal to or exceeds a preselected minimum intensity; or (iv) both a preselected minimum IR flicker frequency is detected and the intensity of said ultraviolet portion is equal to or exceeds a preselected minimum intensity.

29. A device for monitoring at least one burner to render an indication of the presence or absence of a flame associated therewith, said device comprising:

(a) first circuit means including at least one phototransistor means responsive to the infrared portion of the spectrum for continuously monitoring over a predetermined time period the spectrum of frequencies emitted by said flame that are substantially within the infrared portion of the electromagnetic spectrum said first circuit means further including at least one feedback control loop for stabilizing the frequency output of said phototransistor with respect to the intensity of said infrared radiation;

(b) second circuit means including at least one ultraviolet tube means responsive to the ultraviolet portion of the spectrum for continuously monitoring over said predetermined time period the intensity of radiation emitted by said flame that is substantially within the ultraviolet portion of the electromagnetic spectrum;

(c) housing means for containing said first and second means and directing said first and second means toward said burner;

(d) microcomputer means programmed to determine whether at least a selected one of the following sets of conditions is met;

(i) a preselected minimum IR flicker frequency is present in said spectrum;

(ii) the intensity of said ultraviolet portion is equal to or exceeds a preselected minimum intensity;

(iii) either a preselected IR minimum flicker frequency is present in said spectrum, or the intensity of said ultraviolet portion is equal to or exceeds a preselected minimum intensity; or (iv) both a preselected minimum IR flicker frequency is present in said spectrum and the intensity of said ultraviolet portion is equal to or exceeds a preselected minimum intensity; and (e) at least one memory means for storing a plurality of programs ,said programs including at least one of conditions (i)–(iv), said device further including means for selecting which one of said programs shall control said microcomputer means;

(f) bar graph means for giving an indication of whether the selected one of said set of conditions is satisfied, thereby indicating a flame present condition.

30. The device of claim 29, wherein said microcomputer means comprises means for timing the interval between application of an energizing potential to said UV tube and the firing of said UV tube, said computer being responsive to said time interval to calculate the intensity of the UV radiation emitted by said flame.

31. The device of claim 30, wherein said timing means includes a counter.

32. The device of claim 31, wherein said microcomputer means is programmed to substantially remove at least one power line frequency harmonic component from said frequency spectrum produced by said phototransistor.

33. The device of claim 32, further comprising means for selection of which of the plurality of programs is to be applied by the microcomputer means.

* * * * *

UNITED STATES PATENT AND TRADEMARK OFFICE

CERTIFICATE OF CORRECTION

PATENT NO. : 4,882,573

DATED : Nov. 21, 1989

INVENTOR(S) : John K. Leonard and Roland Fabry

It is certified that error appears in the above-identified patent and that said Letters Patent is hereby corrected as shown below:

Col. 11, line 21, "with" second occurrence should be --said--;

Col. 11, line 26, "of" second occurrence should be --or--;

Col. 13, line 10, "of" should be --or-- (first occurrence);

Col. 14, line 21, "of" should be --or-- (second occurrence);

Col. 14, line 50, ";" should be --.--;

Col. 15, line 56, "lien" should be --line--.

Signed and Sealed this

Fifth Day of February, 1991

*Attest:*

HARRY F. MANBECK, JR.

*Attesting Officer*

*Commissioner of Patents and Trademarks*